US005159722A

United States Patent [19]

Diethelm

[11] Patent Number: 5,159,722

[45] Date of Patent: Nov. 3, 1992

[54] DRIVE FOR A SHOWER ARM OR A BIDET DEVICE

[75] Inventor: Alois Diethelm, Tuggen, Switzerland

[73] Assignee: Geberit AG., Jona, Switzerland

[21] Appl. No.: 679,443

[22] Filed: Apr. 2, 1991

[30] Foreign Application Priority Data

Apr. 3, 1990 [CH] Switzerland ..... 1107/90

[51] Int. Cl.[5] ..... A47K 3/20

[52] U.S. Cl. ..... 4/420.4; 4/443; 4/448

[58] Field of Search ..... 4/447, 448, 443, 420.4, 4/420.5, 444, 420.1, 420.2, 420.3, 445, 446; 239/200, 201, 202, 203, 204, 87, 533.1, 533.15, 726

[56] References Cited

U.S. PATENT DOCUMENTS 4,327,451 5/1982 Baus ..... 4/447 X

FOREIGN PATENT DOCUMENTS 2142055 1/1985 United Kingdom ..... 4/420.4

*Primary Examiner*—Henry J. Recla
*Assistant Examiner*—Thomas J. Sweet
*Attorney, Agent, or Firm*—McGlew & Tuttle

[57] ABSTRACT

A shower arm (9) drive for a bidet is provided in which the shower arm, a lever type drive mechanism (37), a piston cylinder (36), and a water distributor (34) are fastened on a support plate (1). To extend the shower arm (9) for the showering process, the pressure chamber (39) of the piston cylinder (36) is connected to the water mains by actuating a pressure switch. The piston (21) is pushed forward against the restoring force of a compression spring by the pressure of the water fowing into the chamber (39), and the shower arm (9) is extended via the lever type drive mechanism (37). A control valve (12) regulates the admission of warm shower water to a nozzle (10) arranged at the front end of the shower arm (9). The drive permits space-saving arrangement and the installation of the drive in a water closet lid.

13 Claims, 4 Drawing Sheets

DRIVE FOR A SHOWER ARM OR A BIDET DEVICE

FIELD OF THE INVENTION

The present invention pertains to a drive for a shower arm of a bidet device provided with a water closet or toilet, wherein the shower arm can be displaced with a drive in a longitudinal direction between an extended position and a retracted position.

BACKGROUND OF THE INVENTION

A shower arm consisting of two telescopically composed cylindrical tubes has become known in the state of the art from GB-2,172,802. If pressure is exerted on the cylinder by warm wash water, the foremost tube and the middle tube telescopically extend against the restoring force of a spring. When the pressure subsides, the cylinder drops back into the resting position. This shower arm has the advantage of having a short overall length, but the disadvantage that the shower arm has a complicated design and especially has sliding packings which may lead to disturbances and frequently cause leakage. A shower arm moved with an electric motor has become known from U.S. Pat. 4,570,274. The above-mentioned sealing problems are avoided in this drive, but a relatively expensive electric motor is needed, and it needs to be protected especially from corrosion, and requires corresponding electrical devices. Drives with an electric motor have also become known from DE-A 38,17,904.

SUMMARY AND OBJECTS OF THE INVENTION

It is an object of the present invention to provide a drive of the aforementioned class, which avoids the above-mentioned disadvantages and yet can be manufactured with dimensions that permit installation in a hollow projection of a water closet lid.

According to the invention, a shower arm drive arrangement for a bidet device provided on a water closet or toilet is provided wherein the shower arm can be displaced with a drive in a longitudinal direction between an extended position and a retracted position. The drive includes a hydraulic piston cylinder which can be connected to the water mains via a valve. The piston cylinder and the shower are connected via a drive linkage which transforms the stroke movements of the piston cylinder into longitudinal movements of the shower arm.

In the drive according to the present invention, the connection to the water mains, which is already present in a bidet device, is used to displace the shower arm. Since the drive is not inteqrated in the shower arm, this can be manufactured with a substantially simpler design and at lower cost. Sliding packings are not necessary in this shower arm, and the associated sealing problems are avoided.

The arrangement of the drive outside the shower arm has the further advantage that it is more readily accessible for inspection or repair, and components that may be damaged can be replaced in a simpler manner.

One essential advantage of the drive according to the present invention is considered to be the fact that with a small overall height and otherwise relatively small dimensions, it can be integrated within a tubular installation part, which also has especially a heating device for the shower water.

The arrangement in space can be realized especially advantageously if the stroke movement is deflected by ca. 90° e.g., the stroke movement is transmitted to the shower arm which moves in a direction which is substantially perpendicular to the stroke movement direction so, so that the movement of the piston extends approximately perpendicularly to the movement of the shower arm.

It was further found that a lever mechanism operates particularly reliably and can be manufactured with small dimensions. However, other drive mechanisms, which operate, e.g., with an endless bead chain and drive gears, are also conceivable.

The piston is reset preferably by a compression spring inserted into the piston cylinder. This can be substantially shorter than the tension spring known from a telescopic shower arm, because the stroke is substantially shorter as a consequence of the displacement ratio of the drive mechanism than the path of displacement of the shower arm.

According to a variant of the present invention, the shower arm, the piston cylinder, and the drive mechanism are arranged on a common support plate. This is extremely useful for installation and maintenance. The support plate with the device arranged on it can be designed as a highly compact and stable support plate and can be installed and, if necessary, replaced as one unit.

Installation is simple especially if, according to a variant of the present invention, the piston cylinder and the drive mechanism levers are connected to the support plate and to each other.

According to a variant of the present invention, the shower arm is guided in a groove, e.g., a T-groove. As a result, the shower arm can be mounted on any side, which is advantageous especially for the water flow control valve, which is to be arranged on the shower arm. Further advantageous characteristics will become apparent from the following description.

One embodiment of the present invention will be explained in greater detail below on the basis of the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
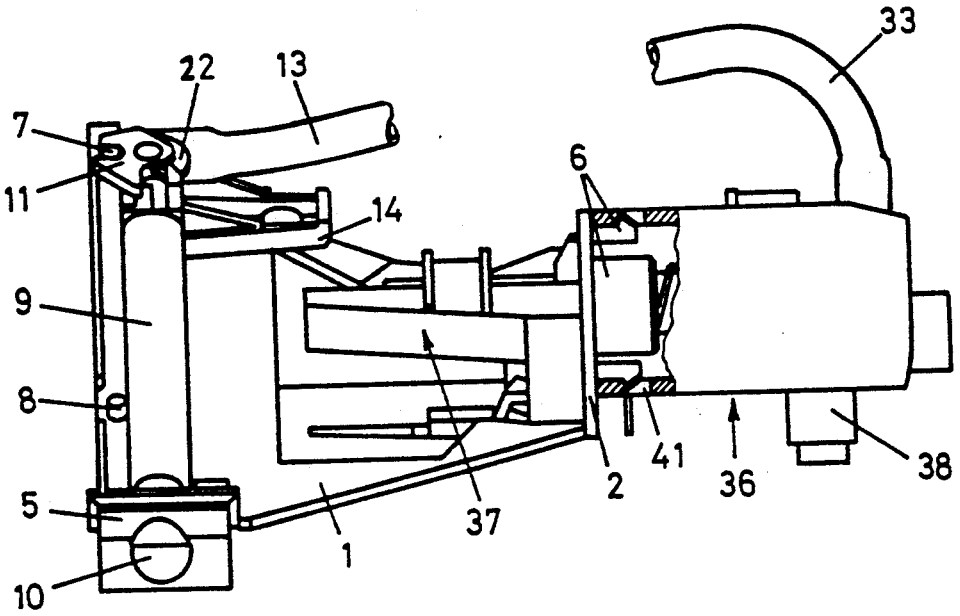
FIG. 1 is a front view of the partially cut-away drive according to the present invention.

A shower arm 9, a lever type drive mechanism or drive linkage means 37, as well as a hydraulic piston cylinder 36 are arranged on a support plate 1 made of plastic. The support plate is arranged next to a heating device that is not shown here. The outlet of this heating device is connected to the shower arm 9 via a hose 13. A water distributor 34 is connected to the water mains via a connection 38. The water distributor 34 feeds water to the piston cylinder 36 as well as to the heating device (not shown here) via the hose 33. It is also possible to regulate the amount of shower water by actuating a knob 35. If the pressure chamber 39 is separated from the water mains, water present in the pressure chamber 39 is able to escape to the outside through an opening that is not shown here. The water distributor 34 is the subject of a simultaneous patent application.

Figure 2:
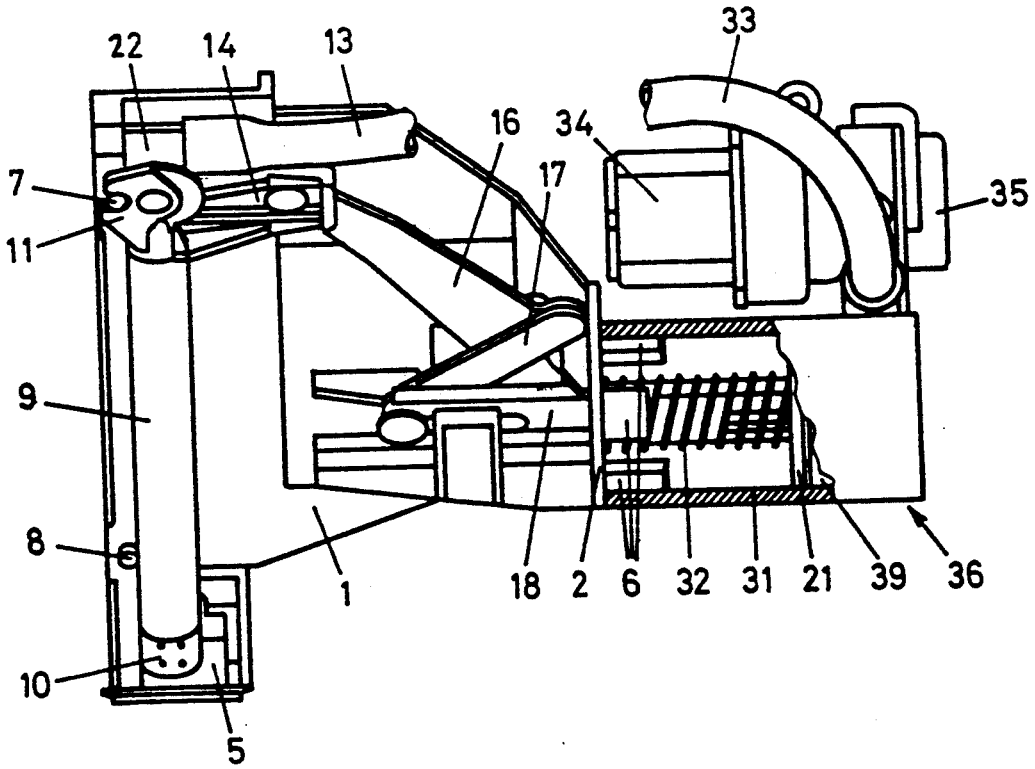
FIG. 2 is a top view of a similarly partially cut-away drive.
Figure 3:
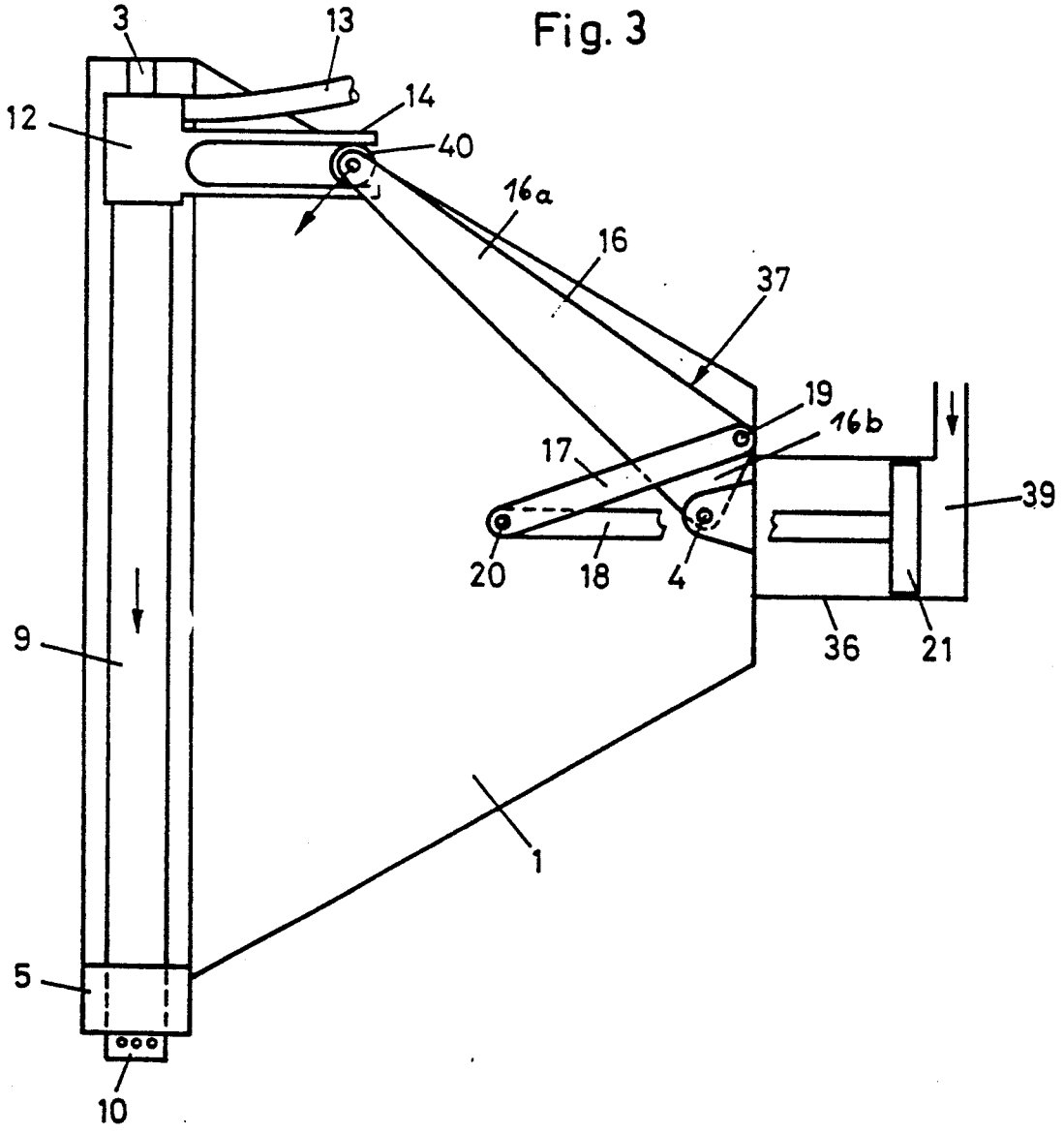
FIGS. 3 and 4 are schematic representations of the drive.
Figure 4:
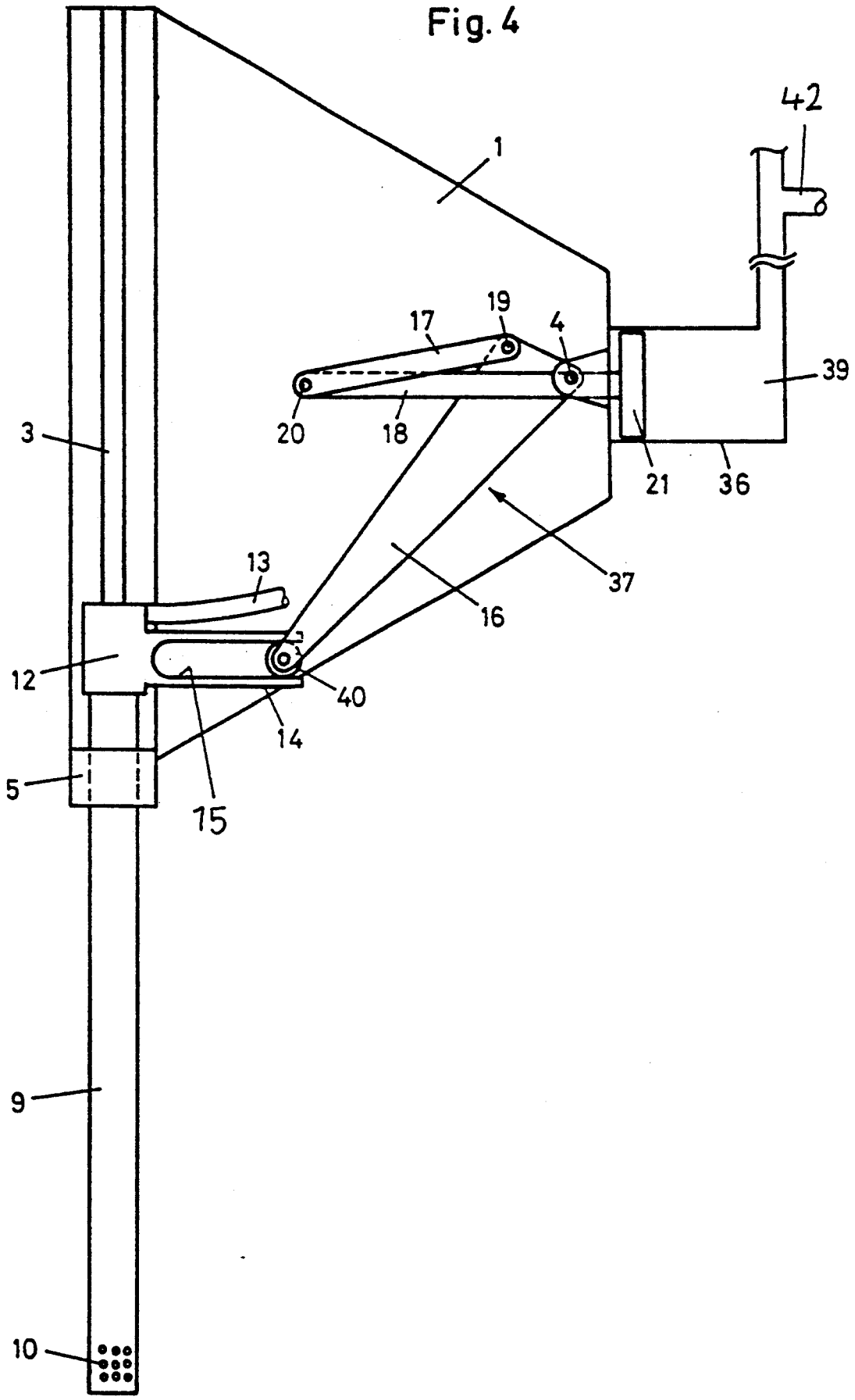

The shower arm 9 has a reversing valve 22, which, by means of a control disk 11, feeds shower water and rinsing water to a nozzle 10 in coordination with the extension of the shower arm 9. The control disk 11 cooperates with the control cams 7 and 8, which are made in one piece with the support plate 1. The shower arm 9 is guided in a T-groove 3 and a guide 5 (see FIG. 3). FIGS. 1 through 3 show the shower arm 9 in the retracted position, in which it is essentially not visible from the outside on the water closet assembly. FIG. 4 shows the drive with extended shower arm 9. The displacement of the shower arm 9 between these two end positions is controlled by the user by actuating a pressure switch, with which water can be fed into the pressure chamber 39 from the water mains. To explain the transmission of the movements, reference will be made below especially to schematic FIGS. 3 and 4.

Figure 5:
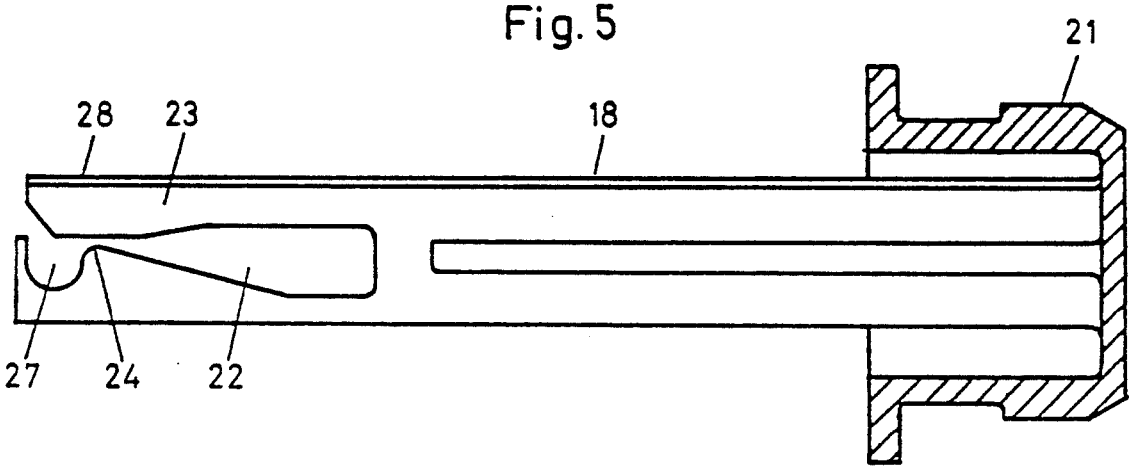
FIG. 5 is a view of the piston and piston rod.
Figure 6:
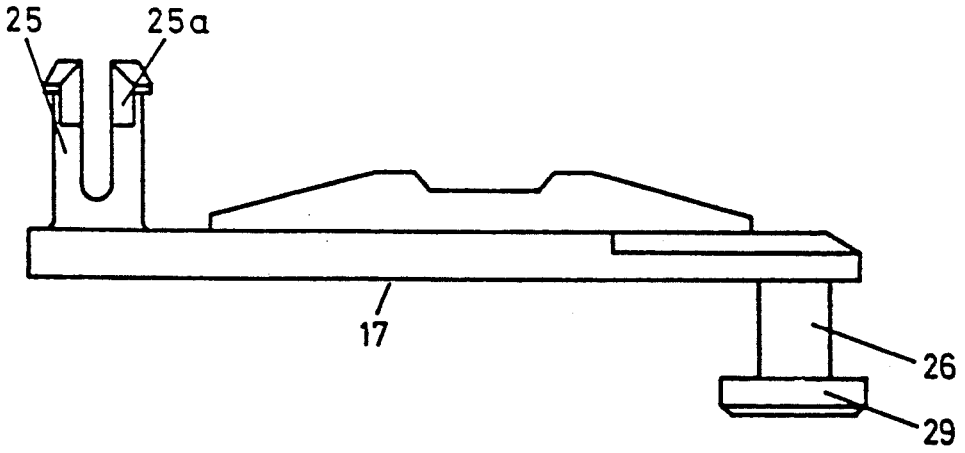
FIG. 6 is a view of a pull lever.

The drive mechanism 37 has a deflecting lever 16, which is rigidly connected to the support plate at a pivot joint 4 and has a longer lever arm 16*a* connected to an arm 14 of the shower arm 9 as well as a shorter lever arm 16*b* connected to a pull lever 17. A pivot pin 40, which is limitedly displaceable and rotatable in a slot 15 of the arm 14, is arranged at the free end of the lever arm 16*a*. The free end of the shorter lever arm 16*b* is connected to the pull lever 17 via a pivot joint 19. As is shown in FIG. 6, the pivot pin 25 of the pivot joint 19 has elastically deflectable snap tongues 25*a*, which are inserted and snapped into a corresponding recess of the lever 16. A pivot joint 20 between the pull lever 17 and a piston rod 18 is formed by a pivot pin 26 made in one piece with the pull lever 17 and a pivoting bearing 27 of a snap-in fork 28 of the piston rod 18. The piston rod 18 and the pull lever 17 are put together, by deflecting a springy elastic tongue 23, such that the pivot pin 26 will snap into the pivoting bearing 27, and a head 29 made in one piece with the pin 26 forms an axial securing device. According to FIG. 5, the pivoting bearing 27 leads via a stop cam 24 into a slot 22 extending toward the piston 21. A safety coupling is thus provided, by which injury to the user or damage to the drive due to overload in the case of unintended pressure on the shower arm 9 is avoided. In the case of such an overload, the pivot pin 26 jumps over the cam 24, while the tongue 23 is being elastically deflected, and it slides into the slot 22. During the retracting movement of the piston 21, the pin 26 will again snap automatically into the pivoting bearing 27.

The mode of operation of the drive mechanism 37 will immediately become apparent from comparison of FIGS. 3 and 4. To displace the piston 21 from the position shown in FIG. 3 into the position shown in FIG. 4, and to extend the shower arm 9, pressure is built up in the pressure chamber 39 by connecting this chamber to the water pipe mains. To perform the opposite movement, the flow passage to the water mains is interrupted, and the pressure chamber 39 is connected to a passage 42 leading to the outside. As a result, the pressure in the chamber 39 will drop, and the compression spring 32 will displace the piston 21 into the position shown in FIG. 3, and the shower arm is also pulled back at the same time.

As is shown in FIGS. 1 and 2, the cylinder 31 of the piston cylinder 36 is fastened on a plate 2 made in one piece with and located at a vertically spaced location from the support plate 1 by means of snap tongues 6, which engage into corresponding snap-in openings 41 of the cylinder 31. This connection also eliminates connection parts susceptible to corrosion, and permits the extensive use of plastics for manufacture as well as simple mounting.

While a specific embodiment of the invention has been shown and described in detail to illustrate the application of the principles of the invention, it will be understood that the invention may be embodied otherwise without departing from such principles.

What is claimed is:

1. A shower arm drive arrangement for a bidet device, comprising: a support, a shower arm having a lengthwise dimension defining a longitudinal direction, said shower arm being displaceably supported by said support for movement in said longitudinal direction between an extended position and a retracted position; drive means for moving said shower arm between said extended position and said retracted position, said drive means including a hydraulic piston cylinder connected to a water main via a valve, said piston cylinder being connected with said shower arm by drive linkage means for transforming a stroke movement of said piston cylinder into said movement in a longitudinal direction of said shower arm, wherein said drive linkage means deflects the stroke movements of said piston cylinder, so that said stroke movement of said piston cylinder is directed approximately perpendicularly to said longitudinal direction of the shower arm.

2. A drive in accordance with claim 1, wherein said drive linkage means includes a lever mechanism.

3. A drive in accordance with claim 1, further comprising a compression spring, which resets a piston of said piston cylinder, said compression spring being arranged in said piston cylinder.

4. A drive in accordance with claim 1, wherein said shower arm, said piston cylinder, and said drive linkage means are arranged on a common support plate (1) of said support.

5. A drive in accordance with claim 1, wherein said shower arm is slidably guided in a groove.

6. A drive in accordance with claim 4, wherein said piston cylinder is fastened on said support plate via snapped-in connection parts.

7. A drive in accordance with claim 2, wherein said lever mechanism includes levers which are connected via snap connections.

8. A drive in accordance with claim 1, wherein said drive means comprises a safety coupling responsive to an overload on the shower arm.

9. A drive in accordance with claim 1, wherein said drive means has a piston to shower arm displacement ratio of 1 to X, in which X equals at least 2.

10. A drive in accordance with claim 9, wherein X is said displacement ratio of 1 to X is substantially equal to 4.

11. A shower arm drive arrangement for a bidet device, the shower arm drive arrangement comprising: a support plate; a shower arm supported by said support plate for linear movement in a longitudinal direction of said shower arm, between an extended position and a retracted position; drive means connected to said shower arm for moving said shower arm in said longitudinal direction, between said extended position and said retracted position, said drive means including a hydraulic piston cylinder connected to a water mains via a valve; drive linkage means connecting said piston cylinder to said shower arm for transmitting linear stroke movement of said piston cylinder into said linear movement in a longitudinal direction of said shower arm, said linear movement of said piston cylinder being substantially perpendicular to said linear movement of said shower arm.

12. A drive in accordance with claim 11, wherein said support plate includes a groove and said shower arm includes an element engaging said groove for sliding movement of said shower arm, along said groove, with respect to said support plate.

13. A drive in accordance with claim 11, wherein said shower arm is connected to a hose at a connection point, said connection point and said hose being movable with said shower arm between said extended position and said retracted position.

* * * * *